United States Patent [19]

Scardera et al.

[11] Patent Number: 5,023,008

[45] Date of Patent: Jun. 11, 1991

[54] ANTI-MICROBIAL COMPOSITION CONTAINING ALIPHATIC POLYGYCIDOL ADDUCTS

[75] Inventors: Michael Scardera, Hamden; Frank R. Grosser, Bethany, both of Conn.

[73] Assignee: Olin Corporation, Cheshire, Conn.

[21] Appl. No.: 438,753

[22] Filed: Nov. 17, 1989

[51] Int. Cl.[5] ..... C11D 3/48; C11D 3/26; C11D 1/75

[52] U.S. Cl. ..... 252/106; 252/548; 252/529; 252/77; 106/18.32; 260/404; 514/668; 514/669

[58] Field of Search ..... 252/106, 548, 529, 77; 514/668, 669; 260/404; 106/18.32

[56] References Cited

U.S. PATENT DOCUMENTS

| | | | |
|---|---|---|---|
| 2,089,569 | 8/1937 | Orthner et al. . | |
| 2,871,266 | 1/1959 | Riley | 252/106 |
| 3,223,644 | 12/1965 | Law | 252/106 |
| 3,962,151 | 6/1976 | Dekker et al. | 252/548 |
| 4,175,062 | 11/1979 | Disch et al. | 252/540 |
| 4,307,079 | 12/1981 | Zorayan et al. | 424/70 |
| 4,414,128 | 11/1983 | Goffinet | 252/111 |
| 4,863,563 | 9/1989 | Scardera et al. | 156/166 |

FOREIGN PATENT DOCUMENTS

| | | |
|---|---|---|
| 80749 | 6/1983 | European Pat. Off. . |
| 2644289 | 4/1978 | Fed. Rep. of Germany . |
| 2113732 | 6/1979 | Fed. Rep. of Germany . |
| 2824636 | 12/1979 | Fed. Rep. of Germany . |
| 405939 | 4/1974 | U.S.S.R. . |
| 572304 | 10/1945 | United Kingdom . |
| 1040543 | 9/1966 | United Kingdom . |
| 1308190 | 6/1983 | United Kingdom . |

OTHER PUBLICATIONS

Application No. 07/276,177 by Michael Scardera, Filed Nov. 25, 1988 entitled "Aqueous Caustic Cleaning Solutions" Assigned to Olin Corporation.

*Primary Examiner*—Josephine Barr
*Assistant Examiner*—Kevin McCarthy
*Attorney, Agent, or Firm*—James B. Haglind; Paul Weinstein

[57] ABSTRACT

Novel nonionic antimicrobial amine glycidol compounds which may be used in cleaning compositions with anionics, nonionics or cationic surfactants as cleaning agents or a preservative in water-based functional fluids or surface coating compositions are represented by the formula:

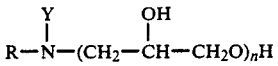

wherein R represents an alkyl group having from about 8 to about 18 carbon atoms and mixtures thereof, Y represents H,

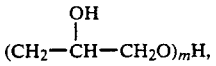

or R′, and mixtures thereof;

R′ represents an alkyl group, the sum total of carbon atoms in R+R′ being from about 8 to about 18;

n is from about 1 to about 6; and m+n are from about 2 to about 12;

wherein the molar ratio of amine glycidol compound to surfactant is from about 10:1 to about 1:10.

15 Claims, No Drawings

ANTI-MICROBIAL COMPOSITION CONTAINING ALIPHATIC POLYGYCIDOL ADDUCTS

The invention relates to antimicrobial compositions, more particularly, the invention relates to antimicrobial compositions based on nonionic surfactants suitable for use in the cleaning and disinfecting of hard surfaces.

General purpose or all-purpose household cleaning compositions for hard surfaces such as metal, glass, ceramic, plastic and linoleum surfaces have been sold commercially in both powdered and liquid form. The powdered compositions consist mainly of builders and buffering salts such as phosphates, carbonates, silicates and the like and these compositions are diluted with water prior to use. While use concentrations of such compositions usually provide good inorganic soil removal, they tend to be deficient in removal of organic soils such as the greasy/fatty/oily soils typically found in the domestic environment. Further, such compositions tend not to be compatible with germicidal ingredients because of the presence of anionic detergents and high concentrations of builder salts.

One the other hand, all-purpose liquid cleaners have met with greater commercial acceptance because they have the advantage that they can be applied to hard surfaces in neat or concentrated form so that a relatively high level of surfactant material is delivered directly to the soils. Because of these advantages, much research and development effort has been expended on formulating all-purpose liquid cleaning compositions which are stable upon storage, have good physical properties and are effective in removing inorganic and organic soils.

Liquid hard surface cleaners generally have been classified into two types. The first type is a particulate aqueous suspension having water-soluble abrasive particles suspended herein, which particles are palpable. Some of the cleaners of this type suffer a stability problem and other cleaners of this type have received poor acceptance by consumers because of their "gritty" feel which causes many people to be reluctant to use then for fear of scratching the surface to be cleaned. The second type is the liquid detergent without suspended abrasive and, seemingly, this latter type is preferred by consumers. While this second type generally is a mixture of surfactant and builder salt in an aqueous medium, the product formulations in the market place have varied widely in composition.

One liquid product which achieved some success was based upon a mixture of soap, alkylbenzene sulfonate and fatty acid alkanolamide plus inorganic builder salts. This liquid product exhibited good temperature stability and a desirable viscosity, but tended to exhibit cleaning disadvantages when compared with another product based upon a mixture of alkylbenzene sulfonate and ethoxylated alkanol plus builder salts. However, the latter composition usually required a high concentration of a lower alkylbenzene sulfonate hydrotrope in order to achieve homogeneity in the presence of builder salt and the inclusion of hydrotrope resulted in lower viscosity and the need of thickening agents.

Other all-purpose liquid products have been prepared which incorporate a solvent such as a terpene. For example, German patent application No. 2,113,732 discloses the use of terpenes as anti-microbial agents in washing compositions. British patent no. 1,308,190 teaches the use of dipentenes in a thixotropic liquid detergent suspension based composition. German patent application No. 2,709,690 teaches the use of pine oil, a mixture of largely terpene alcohols, in liquid hard surface cleaning compositions. U.S. Pat. No. 4,414,128 teaches the use of terpenes with solvents of limited water solubility such as benzyl alcohol in all-purpose cleaning compositions. The terpenes are used to provide cleaning as well as to control sudsing. A similar composition is disclosed in European patent application No. 0080749 which comprises surfactant terpenes, butyl carbitol and builder salts. Again, the terpenes are included for cleaning and as suds regulators.

Despite the extensive efforts in formulating all-Purpose liquid cleaning compositions, there is still a need for a liquid product with both effective cleaning properties and disinfecting properties when applied neat, as well as at various concentrations when used in water. Also such Products should be effective at varying water hardness levels, should have desirable foaming characteristics, and should have little or no spots or streaks whether rinsed or not. Further, the resultant product should be homogeneous at temperatures from about 5° C. to about 49° C. and should exhibit a desirable viscosity. In addition, such a product cannot be achieved by simply adding a germicidal quaternary ammonium compound to one of the liquid products discussed above because the quaternary compounds are rendered ineffective by the proportions of anionic detergent and/or builder salts present in those compositions.

The cleaners of the present invention can be formulated to exhibit desirable characteristics with regard to both physical properties and performance in use. As to physical properties, the composition may be formulated to be homogeneous, pourable, and free-flowing from the container as manufactured as well as after aging at various temperature. For example, they may be formulated to exhibit a high degree of stability upon storage at normal room temperature of about 24° C. over a period of many months without any appreciable precipitation or formation of layers. Also, when subjected to elevated temperatures of about 38° C. or cooled to about 5° C., the liquid will remain in homogeneous form. As a result of this homogeneity, even when only very small quantities are dispensed, the components will be present in the correct proportions. Furthermore, the liquid may be packaged in any suitable container such as metal, plastic, or glass bottles, bags, cans or drums.

The cleaning compositions of the present invention comprise a liquid containing a surface active agent and an antimicrobial effective concentration of a compound represented by the formula:

$$R-\overset{\overset{\displaystyle Y}{|}}{N}-(CH_2-\overset{\overset{\displaystyle OH}{|}}{CH}-CH_2O)_nH$$

wherein R represents an alkyl group having from about 8 to about 18 carbon atoms and mixtures thereof, Y represents H, $$(CH_2-\overset{\overset{\displaystyle OH}{|}}{CH}-CH_2O)_mH,$$

or R', and mixtures thereof;

R' represents an alkyl group, the sum total of carbon atoms in R+R' being from about 8 to about 18;

n is from about 1 to about 6; and m+n are from about 2 to about 12.

The liquid compositions of the present invention include as the cleaning agent, a wide selection of surfactants which can be anionic, nonionic or cationic, as well as mixtures or blends of nonionic surfactants with either anionic surfactants or with cationic surfactants.

Suitable anionic surfactants which may be employed in the cleaning compositions of the invention include alkylbenzene sulfonates or sulfates, alkyl esters of sulfuric acid or sulfonic acids, alkyl ethoxysulfates, phosphate esters, sulfosuccinates as well as sulfate esters of alkylphenol polyglycidol ethers.

Nonionic surfactants which may be used as cleaning agents include, for example, alkyl phenols, oxyalkylated alcohols, oxyalkylated fatty acids, and oxyalkylated amines where the oxyalkyl groups are, for example, oxyethyl or oxypropyl, alkylphenol polyglycidol ethers, and alkyl polysaccharides among others.

Cationic surfactants which may be used as the cleaning agents include for example, quaternary amine surfactants, alkanolamides, and amine oxides.

Of the three broad types of surfactants employed as cleaning agents only cationic surfactants are known to have antimicrobial properties and these appear to be limited to a selected molecular weight range.

Surprisingly, it has been found that antimicrobial properties in the composition of the present invention are provided by nonionic alkylamine glycidol compounds represented by the formula:

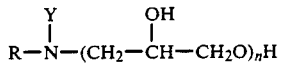

wherein R represents an alkyl group having from about 8 to about 18 carbon atoms and mixtures thereof, Y represents H,

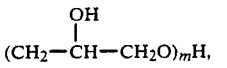

or R', and mixtures thereof,

R' represents an alkyl group, the sum total of carbon atoms in R+R' being from about 8 to about 18;

n is from about 1 to about 6; and m+n are from about 2 to about 12.

The nonionic surfactants represented by Formula I are comprised of a primary or secondary alkyl amine group and the selected number of glycidol groups. Suitable alkyl amines include homogeneous amine groups as well as mixtures such as those sold commercially as coco amines, soya amines, and tallow amines or mixed fatty amines.

While the alkyl groups may be branched or linear, where improved biodegradability is desired, linear alkyl groups with minimal branching are preferred.

Amine glycidol adducts represented include those of Formula I in which R represents, for example, octyl, nonyl, decyl, hendecyl, dodecyl or coco or lauryl, tetradecyl, pentadecyl, hexadecyl, heptadecyl, octadecyl or stearyl (tallow or soya), and mixtures thereof.

Anti microbial effective amounts of the amine glycidol compounds include those which inactivate or prevent the growth of organisms such as bacteria or fungi. In general cleaning formulations, the amine glycidol compound is present in molar ratios to the surfactant present as the cleaning agent of from about 10:1 to about 1:10, preferably at molar ratios of from about 7:1 to about 1:9, with molar ratios of from about 5:1 to about 1:5 being more preferred. The selection of molar ratios of the antimicrobial amine glycidol compound to surfactant is related to the application, institutional use, for example, in hospitals or commercial laundries, may employ compositions having higher molar ratios of the antimicrobial compound.

The cleansing composition of the present invention may also include ingredients such as perfumes, colorants, and sequestering or chelating agents such as ethylenediamine polyacetic acids and their salts incorporated to improve the cleansing properties of the products in hard water.

The preferred form of the cleansing compositions of the present invention is a liquid in which the solvent is water, a water soluble, or a water miscible compound such as an alcohol, glycol or glycol ether. The antimicrobial composition may also be produced in many different forms such as dried granules, flakes, etc., which are well known in the cleansing products industry.

The novel antimicrobial amine glycidol compounds of the present invention may be used as a preservative in water-based functional fluids as well as in surface-coating compositions in which water is a major ingredient. In these and other applications, the amine glycidol compounds are useful in controlling the growth of bacteria and fungi as well as providing surfactant properties without adversely affecting the color, pH or other physical properties of the surface-coating composition. Suitable amounts of the amine glycidol compound used as a preservative include, for example, those in the range from about 0.000001 to about 5 percent by weight.

Applications of the novel antimicrobial compounds of the present invention would include their use in a variety of formulations such as the following:

| | Parts by Weight |
|---|---|
| Bathroom Cleaner | |
| Cocoamine + 3 m glycidol | 0.5–1 |
| Sodium dodecylbenzene sulfonate | 2–3 |
| Ethylene glycol monobutyl ether | 1–2 |
| Tetrasodium EDTA | 2–3 |
| Diatomaceous earth | 3–5 |
| Xanthan gum | 3–5 |
| Water | Balance |
| Hard Surface Liquid Cleaner | |
| Cocoamine + 3 m glycidol | 0.5–1 |
| Lauryl alcohol + 9 m ethoxylate | 2–4 |
| Xanthan gum | 0.1–0.2 |
| Ammonium hydroxide, 28% | 2–3 |
| Water | Balance |
| Toilet Bowl Cleaner | |
| Cocoamine + 3 m glycidol | 0.5–1 |
| Lauryl alcohol + 9 m ethoxylate | 1–2 |
| Xanthan gum | 0.3–0.5 |
| Tetrasodium EDTA | 1–2 |
| Hydrochloric acid 30% | 10–20 |
| Water | Balance |
| Detergent Cleaner Sanitizer | |
| Cocoamine + 3 m glycidol | 1–2 |
| Nonylphenol + 9 m ethoxylate | 5–10 |
| Trisodium phosphate | 2–4 |
| Tetrasodium pyrophosphate | 1–2 |
| Water | Balance |

To further illustrate the invention the following examples are provided without any intention of being limited thereby. All parts and percentages are by weight unless otherwise specified.

TABLE I

| | MINIMAL INHIBITORY CONCENTRATION (PPM) | | | |
|---|---|---|---|---|
| | | *S. Aureus* | *E. Coli* | *A. Niger* |
| | | (Incubation Time) | | |
| | Compound (ppm) | (2 days) | (2 days) | (5 days) |
| Example I | Cocoamine-3 m glycidol | 16 | 128 | 64 |
| Example II | Cocoamine-4 m glycidol | 32 | 128 | 64 |
| Example III | Cocoamine-2 m glycidol | 8 | 32 | 16 |
| Comparative A | Octadecylamine-12 m glycidol | >2048. | >2048 | >2048 |
| Comparative B | Nonylphenol - 10 m glycidol | >25000* | >25000* | |

*5 day incubation

Note: *Staphylococcus aureus* (gram positive), *Escherichia coli* (gram negative), *Aspergillus niger* (fungus).

EXAMPLE 1

Under a nitrogen atmosphere, a blend of aliphatic coco ($C_8$-$C_{18}$) amines (ARMEEN® C, produced by Armak Chemicals), (328 g, 1.64 m) was added to a reaction vessel and heated to 140° C. To the hot amine 364.47 g (4.9 m) of glycidol were added at a rate of about 1.5 g per minute. During the glycidol addition period the reaction temperature was maintained at 140°-150° C. After the glycidol addition the reaction mixture was heated at the reaction temperature for an additional 70 minutes. After cooling, 692 g of a viscous liquid product was recovered and determined to be a 3-mole glycidol adduct of the cocoamine. Antimicrobial activity of this compound was evaluated by determining the Minimal Inhibitory Concentration (MIC) in culture mediums for the microorganisms *Staphylococcus aureus* (gram positive), *Escherichia coli* (gram negative), and *Aspergillus niger* (fungus). The results are given in Table 1 below.

EXAMPLES 2 AND 3

The procedure of Example 1 was repeated exactly using molar ratios of glycidol to the blend of aliphatic cocoamines (ARMEEN® C) of 1:4 and 1:2, respectively.

COMPARATIVE EXAMPLE A

The procedure of Example 1 was employed to react an octadecylamine with glycidol in a molar ratio of 1:12. The results are given in Table 1 below.

COMPARATIVE EXAMPLE B

The Minimal Inhibitory Concentration (MIC) was determined for a commercial nonionic surfactant, a nonyl phenol adduct with 10 moles of glycidol. The results are given in Table 1 below.

What is claimed is:

1. A cleaning composition which comprises an aqueous liquid containing a surface active agent and an antimicrobial effective concentration of an amine glycidol compound represented by the formula:

$$R-\overset{\overset{R'}{|}}{N}-(CH_2-\overset{\overset{OH}{|}}{CH}-CH_2O)_nH$$

wherein R represents an alkyl group having from about 8 to about 18 carbon atoms and mixtures thereof;

R′ represents an alkyl group, the sum total of carbon atoms in R+R′ being from about 8 to about 18; n is from about 1 to about 6; and wherein the molar ratio of amine glycidol compound to surfactant is from about 10:1 to about 1:10.

2. The cleaning composition of claim 1 in which R′ represents an alkyl group having from 1 to about 4 carbon atoms.

3. The cleaning composition of claim 1 in which R represents decylamine.

4. The cleaning composition of claim 1 in which R represents dodecylamine.

5. The cleaning composition of claim 1 in which R represents tetradecylamine.

6. The aqueous cleaning solution of claim 1 in which R represents cocoamine.

7. An antimicrobial composition for use in controlling bacteria and fungi in an aqueous medium comprising an amine glycidol compound represented by the formula:

$$R-\overset{\overset{R'}{|}}{N}-(CH_2-\overset{\overset{OH}{|}}{CH}-CH_2O)_nH$$

wherein R represents an alkyl group having from about 8 to about 18 carbon, atoms and mixtures thereof, R′ represents an alkyl group, the sum total of carbon atoms in R+R′ being from about 8 to about 18;

n is from about 1 to about 20; and, the compound being present in an antimicrobial effective amount.

8. The antimicrobial composition of claim 7 in which the aqueous medium is a water-based functional fluid.

9. The antimicrobial composition of claim 7 in which the aqueous medium is a surface-coating composition.

10. The antimicrobial composition of claim 7 in which R′ represents an alkyl group having from 1 to about 4 carbon atoms.

11. The antimicrobial composition of claim 7 in which R represents decylamine.

12. The antimicrobial composition of claim 7 in which R represents dodecylamine.

13. The antimicrobial composition of claim 7 in which R represents tetradecylamine.

14. The antimicrobial composition of claim 7 in which R represents cocoamine.

15. The antimicrobial composition of claim 7 in which the antimicrobial effective amount is from about 0.000001 to about 5 percent by weight.

* * * * *